US006432625B1

(12) United States Patent
Verbeeck et al.

(10) Patent No.: US 6,432,625 B1
(45) Date of Patent: Aug. 13, 2002

(54) PROCESSING METHOD PROVIDING COLD BLUE-BLACK IMAGE TONE FOR BLACK-AND-WHITE MATERIALS HAVING SILVER HALIDE GRAIN EMULSIONS

(75) Inventors: Ann Verbeeck, Begijnendijk; Govert Wim De Baecke, Kalken; Johan August Loccufier, Zwijnaarde; Kathy Gaby Elst, Kessel; André Cornelius Roefs, Herentals; Freddy Hendrickx, Olen, all of (BE)

(73) Assignee: Agfa-Gevaert, Mortsel (BE)

( * ) Notice: Subject to any disclaimer, the term of this patent is extended or adjusted under 35 U.S.C. 154(b) by 15 days.

(21) Appl. No.: 09/708,566

(22) Filed: Nov. 9, 2000

Related U.S. Application Data

(60) Provisional application No. 60/168,771, filed on Dec. 6, 1999.

(30) Foreign Application Priority Data

Nov. 26, 1999 (EP) ..... 99204007

(51) Int. Cl.[7] ..... G03C 5/305
(52) U.S. Cl. ..... 430/445; 430/488
(58) Field of Search ..... 430/445, 488

(56) References Cited

U.S. PATENT DOCUMENTS 4,634,660 A 1/1987 Mifune et al.
5,723,267 A 3/1998 Ito
5,928,846 A * 7/1999 Yamashita et al. ..... 430/448
5,948,603 A * 9/1999 Uchichiro et al. ..... 430/445
5,976,758 A 11/1999 Fukui et al.

FOREIGN PATENT DOCUMENTS

EP 0 507 284 A1 10/1992
EP 0 529 526 A3 3/1993
EP 0 529 526 A2 3/1993
EP 0 789 271 A1 8/1997
EP 0 789 272 A1 8/1997
EP 0 980 022 A1 2/2000

* cited by examiner

*Primary Examiner*—Hoa Van Le
(74) *Attorney, Agent, or Firm*—Breiner & Breiner, L.L.C.

(57) ABSTRACT

A method has been described for processing an exposed black-and-white silver halide photographic film material comprising in a hydrophilic light-sensitive layer thereof a binder and silver halide grains being {111} or {100} tabular silver bromo(chloro)iodide or silver chloro(bromo)iodide grains having an average aspect ratio of from 1.2 to 50 and having a silver iodide content of less than 3 mole % based on silver with at least part of it at their grain surface, said method comprising the steps of developing in a developer, fixing in a fixer, rinsing and drying, characterized in that in said developing step the developer comprises an alkali soluble agent having preventing silver dissolution properties, being a mercapto azole compound as presented herein.

5 Claims, No Drawings

PROCESSING METHOD PROVIDING COLD BLUE-BLACK IMAGE TONE FOR BLACK-AND-WHITE MATERIALS HAVING SILVER HALIDE GRAIN EMULSIONS

This application claims priority from provisional application No. 60/168,771, filed Dec. 6, 1999.

FIELD OF THE INVENTION

The present invention relates to a processing method of exposed light-sensitive black-and-white silver halide materials having silver halide grains in their light-sensitive hydrophilic layers.

BACKGROUND OF THE INVENTION

Since the early eighties practical use of light-sensitive silver halide grains or crystals has become common knowledge for anyone skilled in the art of photography. Besides cubic grains having [100] crystal faces, tabular grains having {100} or a {111} crystal habit are well-known. From Eastman Kodak's basic patents relied thereupon those related with the preparation of {111} tabular silver halide grains, sensitivity increase by spectral and chemical sensitization, and coating in a light-sensitive silver halide photographic material, more particularly in a forehardened duplitized radiographic material showing improved covering power for tabular grains having a thickness of less than 0.20 $\mu$m as described in U.S. Pat. No. 4,414,304 and in the patents corresponding therewith in Japan and in the European countries, it becomes clear that problems encountered by making use of such grains are related with image tone and developability as has also been set forth in U.S. Pat. No. 5,595,864. In radiographic applications the film materials are coated with relatively high amounts of silver, in order to provide a suitable sensitometry even if a low radiation dose is applied to the patient as is always desirable. Although the use of {111} tabular silver halide grains permits coating of lower amounts of silver, if compared e.g. with grains having a more globular shape like cubic grains as applied before practical application of said tabular grains, there remains the need to provide an acceptable image tone after development of materials having light-sensitive silver halide layers containing said tabular grains, optionally containing cubic grains.

More particularly if image tone after processing materials having silver bromide cubic grains are compared with materials having silver chloride cubic grains, it becomes clear that cubic grains rich in silver chloride provide a colder bluish-black image tone after processing than do cubic grains rich in silver bromide, showing a warmer reddish-brown image tone as has e.g. been clearly illustrated in Example 1, Table 1 in EP-A 0 794 456 and in the corresponding U.S. Pat. No. 5,712,081.

Otherwise disadvantages encountered with the use of tabular grains coated in a radiographic film material are hitherto unambiguously related indeed with the occurrence, after processing of such materials, of diagnostic images having an unacceptable reddish-brown image tone, which, for radiologists, remains undesired and unpleasant in the context of examination of diagnostic images.

Measures taken in order to get a shift in image tone from reddish-brown to the desired bluish-black color of the developed silver, well-known from the state-of-the-art, are hitherto unsatisfactory. Coating light-sensitive emulsion layers on a blue base as in U.S. Pat. No. 5,800,976 makes increase minimum density, a phenomenon which is interpreted by the radiologist as an undesired increase of "fog density". Incorporation in the other layers of the film material of such dyes or dye precursors providing blue color directly or indirectly (by processing and oxidative coupling reactions) are e.g. known from U.S. Pat. Nos. 5,716,769 and 5,811,229 and EP-A 0 844 520, and JP-A 10-274 824 respectively and causes the same problems as set forth hereinbefore, moreover showing, in the worst cases, staining of the screens with blue dyes diffusing from the material onto the screen, with residual color of dyes due to uncomplete removal of said dyes in, nowadays desired, rapid processing steps and problems related with criticality of generation of imagewise developed blue colored silver and preservation characteristics of the material.

Other complicated solutions laying burden on reproducibility due to a rather complicated layer arrangement have been proposed e.g. in EP-A 0 770 909.

Therefore there remains a stringent demand to get a desired blue-black image tone of diagnostic images without disturbing residual color obtained after processing of the radiographic light-sensitive silver halide film material having stored the latent image of the subject to be examined.

OBJECTS OF THE INVENTION

Therefore it is an object of the present invention to provide a processing method for radiographic film materials (single-side as well as duplitized or double-side) coated in its light-sensitive layer(s) with one or more spectrally sensitized silver halide emulsion(s) in order to get a diagnostic image having a desired cold blue-black image tone.

It is a further object of the present invention to get the desired contrast in diagnostic imaging making use of (intensifying) screen-film combinations wherein single-side coated as well as double-side coated materials comprising said silver halide grains are coated, in combination with one or two screens respectively.

It is moreover a preferred object of the present invention to get a diagnostic image with an improved image tone for each processed material as obtained after exposure and processing, without the need to change anything in the layer composition and/or layer arrangement of materials having silver halide grain emulsions as set forth hereinafter in the statement of the invention.

Further objects and advantages of the present invention, which may be obtained by specific embodiments, will become apparent from the description hereinafter.

SUMMARY OF THE INVENTION

In order to reach the objects of the present invention a processing method has thus been provided for an exposed black-and-white silver halide photographic film material comprising in one or more hydrophilic light-sensitive layer (s) thereof a binder and silver halide grains being {111} or {100} tabular silver bromo(chloro)iodide or silver chloro (bromo)iodide grains having an average aspect ratio of from 1.2 to 50 and having silver iodide in an amount of less than 5 mole %, and more preferably less than 3 mole % based on silver (with at least part of it-at their grain surface), said method comprising the steps of developing in a developer, fixing in a fixer, rinsing and drying, characterized in that in said developing step the developer comprises an alkali soluble agent or compound having preventing silver dissolution properties, wherein said alkali soluble compound, as presented in the description hereinafter and in the claims, is a mercapto-azole compound having alkali soluble groups.

DETAILED DESCRIPTION OF THE INVENTION

While the present invention will hereinafter be described in connection with preferred embodiments thereof, it will be understood that it is not intended to limit the invention to those embodiments.

The above mentioned objects are thus realized by providing a method of processing of a light-sensitive black-and-white silver halide photographic material containing emulsion grains having a silver iodide content of less than 3 mole %, and even more preferred of less than 1 mole % based on silver, with at least part of said silver iodide at their grain surface, wherein said method comprises the steps of developing, fixing, rinsing and drying, wherein during said processing said developer comprises, besides one or more developing agent(s), one or more agent(s) preventing oxidation thereof and agent(s) providing pH buffering in running equilibrium conditions during said processing, at least one alkali soluble agent or compound preventing silver dissolution, according to the general formula (I)

(I)

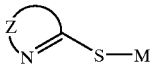

wherein said agent stands for a mercapto azole compound, having at least one alkali soluble group, selected from the group consisting of carboxylic acid, sulphonic acid and phosphonic acid, wherein Z represents an atom capable of closing a 5- or 6-membered ring, differing from a thiadiazole ring, and wherein M is selected from the group consisting of a group providing a thiolate anion under alkaline processing conditions and a charge compensating counterion for the said thiolate anion.

In the processing method according to the present invention, said silver halide grains are {111} or {100} tabular silver bromo(chloro)iodide or silver chloro(bromo) iodide grains having an average aspect ratio of from 1.2 to 50. It is understood that the halide, first mentioned in the composition as described, is present therein in the highest amount, expressed in molar amounts, based on silver.

According to a more preferred embodiment of the present invention all of said silver halide grains have a silver iodide content of from 0.1 up to 1 mole % based on silver. These low amounts are e.g. particularly favourable with respect to rapid processing ability and in an even more preferred embodiment said silver halide grains have silver iodide at their surfaces in an amount of from 0.1 up to 1 mole % and even more preferably in an amount of from 0.1 up to 0.4 mole % based on silver.

The method of processing of a light-sensitive black-and-white silver halide photographic material thus comprises the steps of developing, fixing, rinsing and drying, wherein during said processing said developer comprises, besides one or more developing agent(s), one or more agent(s) preventing oxidation thereof and agent(s) providing pH buffering in running equilibrium conditions during said processing, at least one alkali-soluble agent having preventing silver dissolution properties as set forth hereinbefore, wherein said agent or compound is present in the developer solution in an amount of from $5\times10^{-5}$ up to $1\times10^{-3}$ mole per liter of said developer, more preferably from $5\times10^{-5}$ up to $1\times10^{-3}$ mole per liter. For a compound according to the general formula (I) having a molecular weight of e.g. 160, this corresponds with an amount in mg of from 8 up to 160 mg/l of developer solution.

According to the processing method of the present invention said mercapto azole compound is a compound selected from the group consisting of tetrazoles, triazoles, benzotriazoles, imidazoles, benzimidazoles, oxazoles, benzoxazoles, thiazoles, benzthiazoles, selenazoles, benzselenazoles, diazoles, indazoles, iso-oxazoles, isothiazoles and oxadiazoles.

In a preferred embodiment said alkali soluble agent having preventing dissolution properties, being a mercapto azole compound is represented by formula (II) or a salt thereof, wherein the alkali soluble group is a carboxylic acid group:

(II)

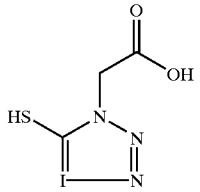

According to the present invention said mercapto azole compound is present in the developer in an amount of from 20 up to 50 mg per 100 ml of developer ready-for-use.

Other agents or compounds suitable -for use in the developer solution in the processing method of the present invention are represented by the formulae (III) to (XXVI) hereinafter (III)

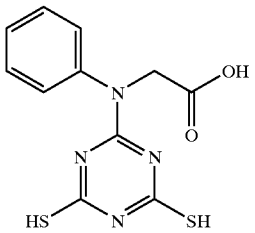

(IV)

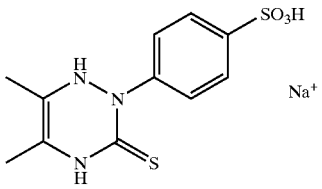

(V)

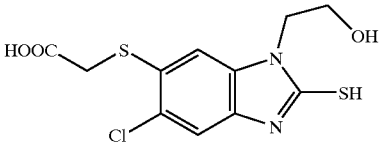

(VI)

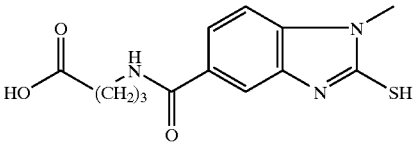

-continued
(VII)
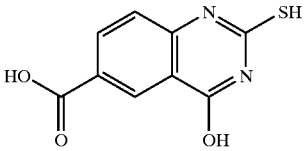
(VIII)
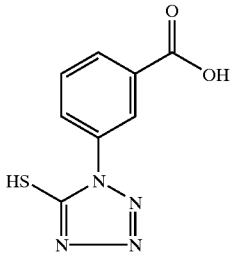
(IX)
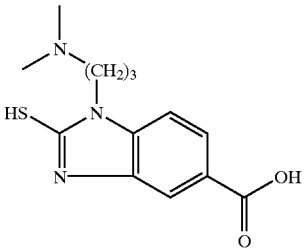
(X)
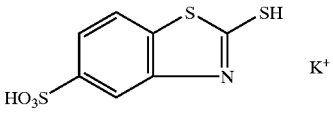
(XI)
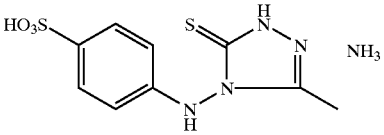
(XII)
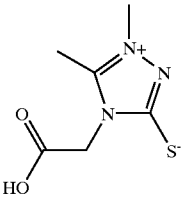
(XIII)
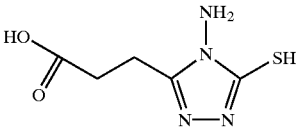
(XIV)
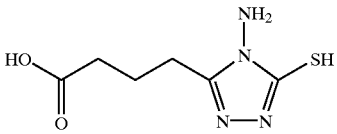
(XV)
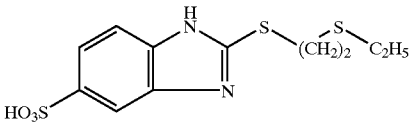
-continued
(XVI)
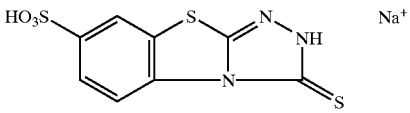
(XVII)
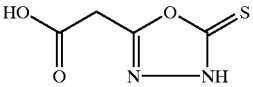
(XVIII)
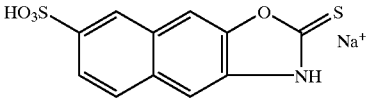
(XIX)
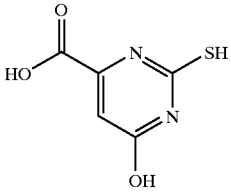
(XX)
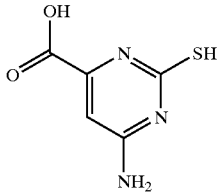
(XXI)
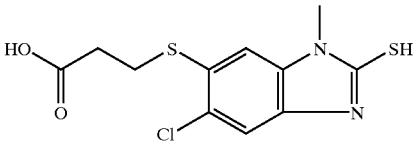
(XXII)
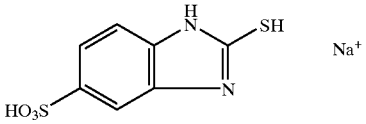
(XXIII)
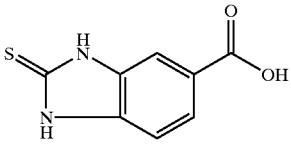
(XXIV)
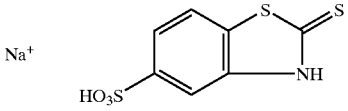
(XXV)
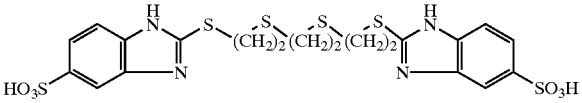

-continued (XXVI)

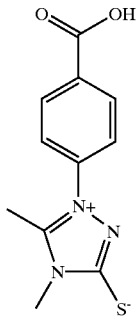

(XXVII)

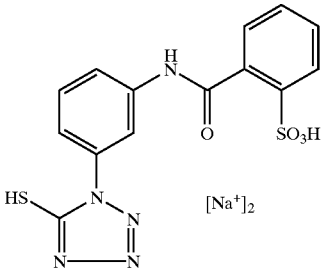

(XXVIII)

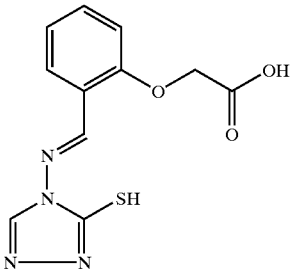

(XXIX)

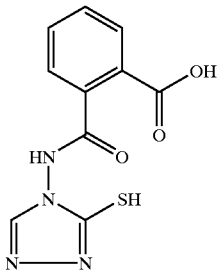

(XXX)

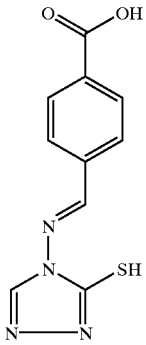

-continued (XXXI)

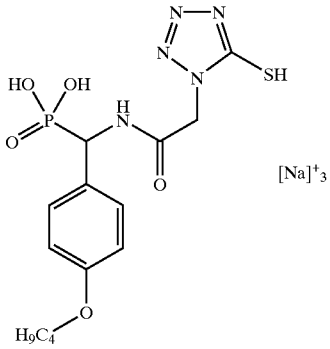

(XXXII)

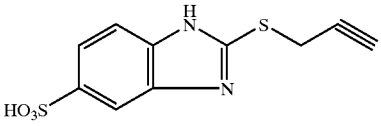

(XXXIII)

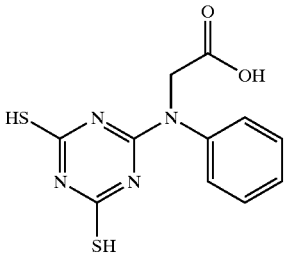

In the following description the developer solution may be any of the solutions which is used in order to develop a photographic material, i.a. a starting solution, a seasoned developer, a developing solution ready-for-use or the concentrated developer compositions thereof.

In order to avoid problems it is advised to make use of a developer starter solution: in order to minimize differences of performance of the photographic system minimizing differences in the composition between fresh and seasoned fixer solution is preferred, in that upon starting the process with a fresh developer, the developer solution chemistry in the processor is the replenishment developer solution chemistry, whether or not with a supplementary additive mixed therewith, said supplementary additive being the developer starter solution.

Said "fresh developer" is defined as the developer present in the developer unit of the processor before any film has passed, or in the alternative, the developer in which a very little amount of film was run, well before a steady state or equilibrium situation is reached (e.g. resulting in a "half-seasoned" developer).

The "developer replenisher solution" is defined as the unused developer present in the developer container which is, in the method of the present invention, mixed in the developer unit with developer starter solution in order to prepare the "fresh developer" solution defined hereinbefore. It is clear that said "developer replenishing solution" is added further to the developer unit as the film is being processed, acting as a commonly used "replenisher" too.

The "seasoned developer" is defined as the developer present in the developer unit of the processor after processing enough film in order to reach a steady-state or an equilibrium situation, depending on the amounts of replenisher used. In order to reach said steady-state, the said developer is topped up with the "developer replenisher solution" defined hereinbefore. The said "seasoned developer" is the same as the developer in "running equilibrium conditions".

As already mentioned hereinbefore the said developer solution comprises a mixture of a developer starter solution and developer replenisher solution, wherein it is understood that both solutions have been mixed before addition to the developer unit or tank of the automatic processor. In another embodiment an additional step is the step of adding of a developer starter solution to the developer replenisher solution which is present in the said developer unit or tank. In that case said developer starter solution is preferably added before starting processing, although it is not excluded to add the said developer starter solution during processing, i.e. after the processing has been started, before an equilibrium or seasoned state has been reached. It is clear however that the advantages related with this invention will only fully be attained when addition of the said starter developer solution proceeds before starting the processing cycle, i.e. when adding developer starter solution to developer replenisher solution the latter being present in a developer unit or tank of the processor. The case wherein developer starter solution is present in the developer tank before developer replenishing solution is added thereto and mixed therewith is however not excluded, so that more generally the method of the present invention comprises the step of mixing of developer starter solution and fixer replenishing solution in a developer unit or tank of the said processor. In a preferred embodiment said developer starter solution is mixed with the developer replenishing solution in the processor before starting processing.

In one embodiment the developer starter solution is a buffering solution. Said buffering solution alters pH of the developer to the required value: so in a preferred embodiment said developer starter solution alters pH to a value in the range from −0.3 up to +0.3 units of the pH of the developer solution after seasoning. In another embodiment said developer starter solution is water or an alkaline solution. In still another embodiment an amount of developer starter solution is proportional to tank volume of the developer solution in the processor. In a further embodiment an amount of developer starter solution is less than 10% of volume of replenisher solution with which it is mixed upon starting processing.

Developer solutions may contain glutardialdehyde as hardening agent but in a preferred embodiment, favourable with respect to ecology, the developer is free thereof. It is clear that the light-sensitive black-and-white silver halide photographic materials processed in the developing composition by the method according to the present invention should be hardened to such an extent that in a developing step free from hardening agents no problems occur as e.g. "sludge formation" in form of troubles due to lack of physical strength properties of the materials. A survey of hardening agents available in order to foreharden coated hydrophilic gelatinous layers of the said photographic materials has been given e.g. in Research Disclosure 38957, Chapter II. Vinyl sulfonyl hardeners are nowadays preferred as instant hardeners, which is e.g. not the case with formaldehyde.

In the processing method according to the present invention a main developing agent is present in the developer, wherein said agent is selected from the group consisting of hydroquinones and reductones or a combination thereof, wherein said reductones preferably are members selected from the group consisting of 1-ascorbic acid, iso-ascorbic acid, and reductic acid.

Said 1-ascorbic acid, iso-ascorbic acid and reductic acid are the more preferred forms from the ascorbic acid type developers according to the formula (XXVII)

(XXXIV)

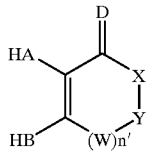

wherein in the formula (XXXIV) each of A, B and D independently represents an oxygen atom or $NR'^1$;

X represents an oxygen atom, a sulfur atom, $NR'^2$; $CR'^3R'^4$; C=O; $C{=}NR'^5$ or C=S;

Y represents an oxygen atom, a sulfur atom, $NR''^2$; $CR''^3R''^4$; C=O; $C{=}NR''^5$ or C=S;

W represents an oxygen atom, a sulfur atom, $NR'''^2$; $CR'''^3R'''^4$; C=O; $C{=}NR'''^5$ or C=S;

n' equals 0, 1 or 2;

each of $R'^1$ to $R'^5$, $R''^2$ to $R''^5$ and $R'''^2$ to $R'''^5$ independently represents hydrogen, alkyl, aralkyl, hydroxyalkyl, carboxyalkyl, alkenyl, alkynyl, cycloalkyl, cycloalkenyl, aryl or heterocyclyl; and wherein $R'^3$ and $R'^4$, $R''^3$ and $R''^4$, $R'''^3$ and $R'''^4$, may further form a ring together; and wherein in the case that $X{=}CR'^3R'^4$ and $Y{=}CR''^3CR''^4$, $R^3$ and $R'^3$ and/or $R^4$ and $R'^4$ may form a ring and in the case that $Y{=}CR''^3R''^4$ and $Z{=}CR'''^3CR'''^4$ with n=1 or 2, $R'^3$ and $R''^3$ and/or $R'^4$ and $R''^4$ may form a ring.

In a preferred embodiment when in the formula (XLI) A, B and X each represent an oxygen atom; n'=0; Y=CH—$(CHOH)_{m'}$—$CH_2$—$R'^6$ wherein m'=1,2,3 or 4 and wherein $R'^6$ represents OH for m'=1; and H or OH for m'=2, 3 or 4, this formula corresponds with (iso)ascorbic acid. As a suitable derivative iso-ascorbic acid and 1-ascorbic acid are both preferred. In another preferred embodiment A and B each represent an oxygen atom; n'=O and X and Y each correspond with $C(CH_3)_2$. That formula corresponds with tetramethyl reductic acid.

The compound(s) according to the formula (XLI) preferably is(are) present in the developer solution in an amount comprised between 1 g and 100 g per litre, although a preferred amount of from 20 up to 50 g per litre is sufficient in many cases. Examples of reducing precursor compounds suitable for use in the developer of the present invention have, e.g., been described in WO's 94/3834 and 94/16362.

1-phenyl-3-pyrazolidine-1-ones (phenidones), salts and derivatives thereof are normally used as auxiliary developing agents.

It is clear that within the context of the present invention ascorbic acid is not merely used in the developer as an antioxidant as e.g. described in WO 93/12463, in JP-A's 4428673 and 55149936, in GB 1,266,533 and in U.S. Pat. Nos. 3,865,591; 4,756,997 and 4,839,259 and in the literature as, e.g., J. Am. Chem. Soc., 60 (1938), p. 99 and p. 2084; 61 (1939), p. 442; 64 (1942), p. 1561, 65 (1943), p. 1489; 66 (1944), p. 700 and 104 (1982), p. 6273. According to the method of the present invention said antioxidant or agent preventing oxidation is selected from the group consisting of a sulfite salt, l -ascorbic acid, iso-ascorbic acid, reductic acid, salts and derivatives and combinations thereof. A combination of high amounts of ascorbic acid type compounds and low amounts of sulfite is therefore highly preferred as the presence of sulfite normally leads to undesirable odours in the processing. Low amounts of sulfite as e.g. disclosed in EP-A 0 738 400 are therefore preferred: amounts of less than 0.4 mole per liter of developer are satisfactory in order to prevent oxidation by air oxygen.

A preferred phenidone compound used in the method of the present invention is 4,4'-hydroxymethyl-methyl-1-phenyl-3-pyrazolidine-1-one, which is present in amounts of from 0.5 g up to 5 g/litre of developer. Especially if iodide ions are present in the developing solution, said preferred phenidone compound is present in lower amounts as has been disclosed in U.S. Pat. No. 5,296,342.

According to the method of the present invention a pH buffering agent is present, wherein said buffering agent is selected from the group consisting of carbonates, phosphates and borates and combinations thereof. More particularly carbonate buffers applied may be those described in EP-A's 0 565 459 and 0 736 802 (together with borate) and in U.S. Pat. Nos. 5,648,205 and 5,738,979; whereas borate buffers may be those as described in GB-A 2,292,813 and in U.S. Pat. Nos. 5,702,875; 5,756,271 and 5,853,964 and phosphate buffers as in U.S. Pat. Nos. 5,585,610; 5,744,279; 5,858,612 and 5,876,907. It is well known that the amount of alkali necessary during development is largely dependent on two factors, namely the amount of silver to be developed (g/m2) and the amount of acid released during the development reaction (mmoles of hydrogen ions released per mole of developed silver). As has been extensively disclosed in EP-A 0 962 820 it has been found that, apart from these factors, which were known before, there is another important contribution, in particular in the case of ascorbic acid developers used at low regeneration rates, and that the main factor which causes these differences is the buffer capacity of the film materials as defined therein. Accordingly in the method of the present invention the said processing further comprises the step of replenishing the developer composition in an amount of less than 200 ml/m2 and, moreover, the said replenishing proceeds with a replenisher having the same composition as the developer composition.

In order to provide a stable or constant sensitometry in the method according to the present invention when processing is performed at low replenishment rates (as e.g. lower than 200 ml per sq.m., more preferably 150 ml per sq.m. and even lower than 100 ml per sq.m. as described in EP-A 0 874 276) it is recommended, as further described in EP-A 0 962 820, in particular for photographic materials having silver halide, coated in an amount, expressed as an equivalent amount of silver nitrate of less than 6 g/m$^2$ that the said material has a buffering capacity of less than 6 mmole/m$^2$, preferably of less than 4 mmole/m$^2$ and even more preferably less than 2.5 mmole/m$^2$, wherein said buffering capacity is defined as the amount of alkali, expressed in mmole/square meter required to bridge across pH differences between the material and the developer. In a preferred embodiment said processing proceeds in a total dry-to-dry processing time of less than 100 seconds. It is however clear that the method of the present invention is not restricted to the processing of materials coated with such low amounts of silver halide and that also silver halide materials more rich in coated amounts of silver, as e.g. double-side coated materials for non-destructive testing purposes having an amount of silver up to 20 g per sq.m. and per side of the support, said amount of silver being expressed as an equivalent amount of silver nitrate, as disclosed e.g. in EP-A 0 698 817. In a preferred embodiment according to the method of the present invention the developer solution is buffered between a value of from 9.0 up to 11.0 by buffering compounds having a concentration of from 0.3 up to 1.0 mole/litre and more preferably from 0.3 up to 0.7 mole/litre. Particularly suitable buffering compounds in the developing solution are carbonates as has also been shown in EP-A 0 565 459 wherein the use of ascorbic acid developers with high concentrations of carbonate buffering is illustrated. The high carbonate level provides a high degree of pH buffering and also provides aeration protection via reduced oxygen solubility in the developing solution. Use of highly buffered ascorbic acid developers has been disclosed e.g. in U.S. Pat. No. 5,503,965, wherein the instability of ascorbic acid developers has been tackled not only by the use of highly buffering solutions but in addition by the use of replenisher solutions having a higher pH. The use of developers having a higher buffer capacity however increases the likelihood of aluminum sludging in the fixer, since the pH increase in the fixer solution due to carry-over of alkaline developer will be greater. Therefore it is recommended to add a compound having an α-ketocarboxylic acid structure (as oxalic acid, tartaric acid, citric acid, gluconic acid or derivatives thereof) in an amount of not more than 3 g per litre is present in the said fixer solution while starting processing or in the said fixer replenisher.

In order to compensate during processing for a decrease of pH due to the oxidation of ascorbic acid type developing agents, if present, to oxalic acid it is recommended to provide pH of the developer replenisher to be higher as e.g. in EP-A 0 573 700 and in U.S. Pat. No. 5,869,218 and more particularly about 0.5 higher than the developer itself as in U.S. Pat. No. 5,503,965; although depending on the composition of the developer pH differences of 0.1 to 0.3 pH units may be sufficient as disclosed in U.S. Pat. No. 5,738,979. In the alternative mixtures of two pyrazolidones may compensate for pH drop as has been suggested in EP-A 0 588 408. Ascorbic-acid type developers used in the method of the present invention preferably have a pH in the range from 9–11, but lower values as e.g. in U.S. Pat. Nos. 5,702,875; 5,756,271; 5,853,964 and 5,858,610 are not excluded. Alkalizing agents providing the desired pH are e.g. those described in U.S. Pat. No. 5,821,041. In the method of the present invention the developing solution has a regeneration rate less than 150 ml/m2 and pH of the developing solution in running equilibrium conditions is between 9.5 and 9.9, with a pH difference between the seasoned developer and the developer replenisher between 0.3 and 0.6.

In the method according to the present invention it is further preferred that, in order to provide constant sensitometric and physical properties of silver halide photographic materials after rapid processing in solutions, replenished with minimum amounts of said solutions and in order to specifically minimize the differences between the freshly prepared fixer solution and the fixer solution after seasoning that upon starting of the processing the said fixer solution comprises a mixture of a fixer starter solution and a fixer replenisher solution and in that said fixer solution is replenished is with the said fixer replenishing solution as disclosed in EP-A 0 851 286. In a further preferred embodiment said method comprises the step of mixing a fixer starter solution and a fixer replenisher solution in a fixer unit or tank of the said processor.

In the context of the present invention related with prevention of sludge formation it is further recommended to provide a method to avoid aluminum sludging in fixing solutions and to provide a method to omit environmentally unfriendly boron compounds in fixers containing aluminum, without a further risk of precipitation of aluminum hydroxide, to have highly buffered developing solutions without increased risk of precipitation of aluminum hydroxide in the fixer solution and to provide a method to avoid aluminum sludging of hardening fixing solutions, even when the preservation time of the fixing solution becomes very long. Therefore in the method of processing comprising the steps of developing in a developer solution, followed by fixing in a fixer solution comprising a hardening agent wherein, in running equilibrium conditions, said fixer solution has a pH of at least 4.3, and wherein further a fixer replenisher is added to the said fixer at a (low replenishing) rate of from 0 ml/m$^2$ up to 300 ml/m$^2$, it is recommended to exclude rinsing between developing and fixing and to add a compound having an α-ketocarboxylic acid structure in an amount from 0 to 3 g per litre in the said fixer solution while starting processing or in the said fixer replenisher when as developing agent in the developing solution an ascorbic acid type developing agent is present as has been described in EP-A 0 908 764.

According to the method of the present invention the film material to be processed is a light-sensitive black-and-white silver halide photographic material which is a single-side or double-side coated material, coated on a subbed support with one or more light-sensitive silver halide emulsion layers. In a more preferred embodiment said material is a radiographic material as for such material having diagnostic value it is of utmost importance to provide an image having an optimized image quality for the medicin, also with respect to more perceptible characteristics as image tone in order to make said medicin able to formulate unambiguous conclusions after having viewed said image.

Otherwise according to the present invention in said processing method besides silver halide grains having a tabular crystal habit, cubic silver bromo(chloro)-iodide grains having an average crystal diameter of 0.1 up to 1 μm may be present.

According to the method of the present invention the said light-sensitive silver halide emulsions present individually or as a mixture of different emulsions are present in one or more adjacent layers at one side or at both sides of the support material and grains or crystals present therein may be cubic grains (whether or not with rounded corners as a consequence e.g. of use of grain growth modifiers, such as e.g. methionin, during crystal preparation) more rich in silver chloride or more rich in silver bromide with, preferably, in favour of developablity, at most 3 mole % of iodide and more preferably even from 0.1 up to at most up to 1 mole % up, wherein silver iodide is present at the grain surface in an amount of from 0.1 up to 0.4 mole % and wherein in a further preferred embodiment the crystal diameter of said cubic grains is between 0.1 and 2.0 μm, more preferably between 0.1 and 1.5 μm and most preferably, according to the method of the present invention between 0.1 and 1.0 μm, depending on sensitometric requirements, especially sensitivity.

Emulsions comprising crystals having a habit selected from the group consisting of a {100} tabular, a {111} tabular and a cubic habit and mixtures thereof, suitable for use in the method of the present invention have e.g. been described in BE 93001438, in EP-A's 0 288 949, 0 528 480, 0 555 897, 0 573 373, 0 574 331, 0 592 616, 0 614 111, 0 622 668, 0 581 065, 0 678 772, 0 704 750, 0 709 730, 0 724 193, 0 731 382, 0 736 797, 0 786 694, 0 770 909, 0 809 135, 0 809 139, 0 843 207, 0 851 282, 0 862 083, 0 862 088, 0 866 362, 0 890 873, 0 908 764, 0 911 687, 0 911 688, 0 930 527, 0 932 076, 0 933 670, 0 945 754, 0 949 536 and 0 962 820 and in EP-A 1 026 544 and in U.S. Pat. Nos. 4,400,463; 4,434,226; 4,783,398; 5,035,992; 5,061,609; 5,292,631; 5,230,994; 5,298,372; 5,378,600; 5,420,001; 5,561,038; 5,565,315, 5,607,828; 5,612,176; 5,614,359; 5,629,142; 5,641,620; 5,633,126; 5,677,119; 5,691,128; 5,693,459; 5,707,792; 5,707,793; 5,707,794; 5,712,081; 5,716,769; 5,733,715; 5,756,277; 5,759,759; 5,733,516; 5,733,718; 5,780,209; 5,780,217; 5,800,976; 5,853,972; 5,856,075; 5,871,890; 5,876,913 as well as in WO 93005442.

All these references are related with emulsion preparation of emulsions having a crystal habit and halide composition as set forth hereinbefore, and in more particular references with protective colloids used in the precipitation thereof (as gelatin and derivatives, colloidal silica, oxidized cationic starch, etc.), dopants incorporated in the crystal lattice of the silver halide, built-up of halide in the crystal volume (homogeneous or heterogeneous as in core-shell emulsions), measures to provide more homogenous crystal size distributions of silver halide crystals in silver halide emulsions (with respect to average crystal diameter and/or thickness—where applied ), chemical ripening thereof (with ripening agents providing chalcogen—sulphur, selenium, tellurium—sensitization, noble metal—gold, palladium—sensitization, reduction sensitization, whether or not in combination with each other, spectral sensitization before, simultaneous with or after said chemical sensitization, addition before coating of solutions containing stabilizers, development accelerators—which may also be added to the developing solution in the processing—non-spectrally sensitizing dyes providing image definition or dye precursors providing shift in image tone or dye formation, coating aids, plasticizers, antistatic agents, matting agents, sequestering agents, image tone modifiers, agents enhancing covering power, and even anti-sluding agents—silver complexing agents and silver dissolution inhibiting agents—as disclosed in the method of the present invention, said anti-sludging agents being present in lower amounts than set forth hereinbefore in the processing of coated materials. These topics have also been extensively disclosed in Research Disclosures, further called "RD", No. 340, p. 612–615 (1992); No. 375, p. 491–495(1995); No. 377, p. 607–608 (1995), No. 381, p. 45–59(1996), No. 388, p. 509–512 (1996), No. 389, p. 591–639(1996), No. 391, p. 713–723 (1996),No. 394, p. 100–107(1997), No. 394, p. 120–129 (1997), No. 394, p. 83–89(1997), No. 401, p. 583–594 (1997), No. 404, p. 867–868(1997), and No. 412, p. 1058 (1998).

Emulsions comprising crystals having a habit selected from the group consisting of a {100} tabular grains rich in silver chloride, suitable for use in the method of the present invention have e.g. been described in EP-A's 0 534 395, 0 653 669, 0 584 815, 0 584 644, 0 617 317, 0 617 321, 0 645 670, 0 672 940, 0 670 515, 0 670 514, 0 767 400, 0 768 567, 0 843 207, 0 911 688, 0 949 536; in U.S. Pat. Nos. 5,292,632; 5,320,938; 5,356,764; 5,558,982; 5,565,315; 5,641,620; 5,663,041 and in Research Disclosure No.394 (1997), p.83–89. Said {100} tabular grains are preferably accounting for at least 30% and more preferably at least 50% of the total projective area of all grains, having at least 90 mole% of silver chloride, not more than 1 mole % of silver iodide and more preferably 0.1 up to 0.4 mole % at the grain surfaces.

In another embodiment according to the method of the present invention the said light-sensitive silver halide emulsions present individually or as a mixture of different emulsions are present in one or more adjacent layers at one side or at both sides of the support material and grains or crystals present therein are {111} or {100}tabular grains rich in silver bromide (more than 50 mole % of bromide) or rich in silver chloride (more than 50 mole % of chloride). Said tabular grains preferably account for at least 50% of the total projective surface area of all grains, more preferred for at least 70% and still more preferred for at least 90%, further have an average crystal diameter (equivalent circular diameter leading to an equal total flat surface as the preferred hexagonal {111} or rectangular {100} grain) of from 0.3 to 3.0 μm, more preferably from 0.5 to 2.5 μm and still more preferably from 0.5 to 1.5 μm, for an average thickness of the tabular grain from 0.05 up to 0.30 μm, more preferably from 0.05 to 0.25 μm. Average aspect ratios of the {111} or {100} tabular grains obtained after calculation from the ratio of diameter to thickness measured for each grain are in the range 2:1 to 100:1, more preferably from 5:1 to 50:1 and still more preferably is from 5:1 to 20:1 or even from 8:1 to 20:1. Variation coefficients calculated over grain diameters or thicknesses are preferably less than 0.40, more preferably less than 0.30 and even more preferably in the range from 0.10–0.20, thereby being indicative for the degree of homogeneity of the grain distribution in an emulsion.

It should be established that in order to stabilize the thermodynamically unstable {111} habit of corresponding tabular grains it is recommended to add a crystal habit modifier (being a habit stabilizer) in the preparation step (especially in the growth step of the flat parallel twin planes). This is more preferred for {111} grains rich in silver chloride than for grains rich in silver bromide as, due to large differences in solubility of both silver halides (factor 100) the more soluble silver chloride tends to crystallize in a preferred cubic habit. Preferred crystal habit modifiers which are useful in the preparation of {111} tabular grains for use in the method of the present invention have e.g. been described in U.S. Pat. Nos. 5,176,991; 5,178,997; 5,185,239; 5,217,858; 5,221,602; 5,252,452; 5,272,052; 5,286,621, 5,298,385; 5,298,387; 5,298,388; 5,399,478; 5,411,851; 5,411,852; 5,418,127; 5,601,969; 5,691,128 and 5,756,277.

When phases differing in silver halide composition are present over the crystal volume said crystal is said to have a core-shell structure. More than one shell can be present and between different phases it may be recommended to have a phase enriched in silver iodide by applying the so-called conversion technique during preparation. Iodide ions can be provided by using aqueous solutions of inorganic salts thereof as e.g. potassium iodide, sodium iodide or ammonium iodide and can be added apart (as solution providing conversion) or in a double-jet step together with a silver salt solution as e.g. silver nitrate. Iodide ions can also be provided by organic compounds releasing iodide ions as has e.g. been described in EP-A's 0 561 415, 0 563 701, 0 563 708, 0 649 052 and 0 651 284 and in WO 96/13759. Especially in order-to obtain a more homogeneous iodide distribution in the crystal lattice and over the whole crystal population, apart from presence at the grain surface as in the present invention, iodide ions provided by organic agents releasing iodide ions are preferred such as mono iodide acetic acid, mono iodide propionic acid, mono iodide ethanol and even hydrogels containing iodide ions, capable to generate iodide ions. Another way to provide at least the same result has been described in U.S. Pat. Nos. 5,248,587; 5,318,887 and 5,420,007 wherein use has been made of very fine silver iodide emulsion crystals having an average diameter of about 0.050 μm or even less (so-called Lippmann emulsions). Although preferred with respect to intrinsic and to spectral sensitivity it is recommended to limit average iodide concentrations to up to 1 mole % as set forth hereinbefore, and in favour of image tone, at the grain surface in a more preferably amount of from 0.1 mole % up to at most 0.4 mole %. Higher concentrations are disadvantageous as they retard development and lead to unsatisfactory sensitivities. Moreover the velocity of fixation can be disturbed in that case and as a consequence residual coloration may be unavoidable.

A factor which is important, particularly when in the method of the present invention ascorbic or reductic acid type developing agents are present is the calcium content of gelatin used as a colloidal binder in emulsion preparation and/or coating. In most commercial high-quality inert gelatins the calcium content is about 0.4%, which corresponds with about 100 mmole/kg, measured at the end of the preparation process of inert gelatin. Complex-bound calcium ions strongly decrease the electric potential carried by gelatin. Substantially "calcium free gelatin" is thus defined as gelatin with a calcium content at a level below 40 ppm which corresponds with the analytical detection limit. Use thereof is therefore highly preferred in the context of the method of the present invention in order to avoid sludging as a consequence of formation of calcium oxalate precipitate due to generation of oxalic acid as oxidized developing agent in the processing of such materials. Therefore in the context of the method of the present invention recommended amounts present in the material used in the method of the present invention preferably have a calcium content of less than 10 mg/sq.m. as in U.S. Pat. No. 5,723,267, more preferably of less than 5 mg/sq.m. and still more preferably of less than 3 mg/sq.m..

Dyes absorbing in the blue wavelength region of the visible spectrum for use as spectral sensitizers for cubic and/or tabular silver halide grains can be used as those described in JP-A 01-196031 and in U.S. Pat. Nos. 4,494,212; 4,952,491 and 5,376,523.

As is well-known and as has been described in U.S. Pat. Nos. 5,108,887 and 5,376,523 and in EP-A's 0 622 665 and 0 712 034, zeromethine dyes are very useful in the said wavelength region. In the method according to the present invention spectral sensitization as described in EP-A 0 890 873 can advantageously be applied.

The same applies to the other regions of the visible spectrum as the green wavelength region (see e.g. EP-A 0 678 772) and in the red wavelength range (see e.g. EP-A 0 794 456) and a still broader wavelength range has extensively been covered by spectral sensitizers described in EP-A 0 757 286. As already set forth combinations of differing spectral sensitizers may be used as well as mixtures of emulsions being the same or different, wherein each part may be spectrally sensitized with another spectral sensitizer or with another combination of spectral sensitizers. Spectral sensitizers having asymmetrical heterocycles may be useful with respect to improvements in residual coloration after processing. Other dyes, which do not have any spectral sensitization activity, or certain other compounds, which do not substantially absorb visible radiation, may have a supersensitization effect when they are incorporated together with said spectral sensitizing agents into the emulsion. Suitable supersensitizers are e.g. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,743,510, cadmium salts, and azaindene compounds. Problems in the method of processing according to the present invention related with occurrence of residual dye stain due to the presence of huge amounts of spectral sensitizer (consequence of the large ratio of specific surface of the crystals to the crystal volume as is the case for tabular grains having a high aspect ratio or for very small cubic grains having diameters of less than 0.20 μm) are effectively overcome by application of combinations of J-aggregating and non-J-aggregating dyes as has been described in EP-A 0 953 867.

Besides the light-sensitive emulsion layer(s) the black-and-white photographic material may contain several light-insensitive layers at the side of the support carrying said light-sensitive emulsion layer(s), e.g. a protective antistress layer which can be split up into two layers, one of them being an underlying interlayer or an outermost afterlayer coated or sprayed on top of the "basic" protective antistress layer. Said protective antistress layer may comprise e.g. one or more organic compounds inhibiting development, like e.g. organic compound(s) inhibiting development is(are) preferably (a) benzotriazole compound(s) as disclosed in EP-A 0 866 362. Protective antistress layers present in the materials used in the method of the present invention preferably contain coating aids and coating physical property modifying addenda mentioned in RD's Nos. 36544 and 38957, published September 1994 and 1996 respectively, Chapter IX. Antistatic properties are especially preferred in order to prevent blackening after processing in form of sparks etc. due to abrupt decharging of electrostatic charges during production and/or handling before exposure and/or processing. It is highly preferred to add antistatic agents to the protective antistress layer or to an afterlayer coated thereupon as has been described e.g. in EP-A's 0 534 006, 0 644 454 and 0 644 456 and in U.S. Pat. Nos. 4,670,374 and 4,670,376. Abrasion resistance of these outermost layers may be improved as described in U.S. Pat. Nos. 4,766,059 and 4,820,615. Spraycoating of afterlayers as can be applied has been disclosed e.g. in U.S. Pat. No. 5,443,640. Non-imagewise blackening may alternatively be due to pressure sensitivity of the silver halide grains. Measures in order to prevent pressure sensitivity may be coating of enhanced amounts of binder as e.g. gelatin. This however is disadvantageous with respect to rapid processing and therefore as an alternative silver halide crystals prepared in silica may offer an alternative as has been disclosed e.g. in EP-A's 0 528 476, 0 649 051 and 0 682 287 . Moreover with respect to the binder material in the light-sensitive emulsion layer an improvement of pressure sensitivity can be expected if use is made therein from synthetic clays as has been disclosed in U.S. Pat. No. 5,478,709. As an alternative zeolites may be used as described in EP-A 0 909 981. In the presence however of spectral sensitized emulsion crystals in the said light-sensitive layers care should be taken in order to select suitable synthetic clays as has been disclosed in EP-A 0 757 285.

Besides the protective antistress layer(s) and optional afterlayer(s) as other non-light-sensitive layers one or more subbing layers, one or more intermediate layers e.g. filter layers, antistatic agent(s), filter dyes for safety-light purposes etc. may be present. Intermediate layers eventually containing filter or antihalation dyes that absorb scattering light and thus promote the image sharpness have been described in e.g. U.S. Pat. Nos. 4,092,168; 4,311,787; 5,344,749; 5,380,634; 5,474,881; 5,478,708; 5,502,205; in EP-A's 0 489 973 and 0 586 748 and in EP-A's 0 786 497 and 0 781 816; in DE 2,453,217, and in GB-A 7,907,440. Situated in such an intermediate layer between the emulsion layers and the support there will be only a small negligable loss in sensitivity but rapid processing conditions, although said dyes decolorize very rapidly in alkaline solutions, require minimization of the thickness of the whole coated layer, an item which has already been discussed hereinbefore: multilayer arrangements of thin layers clearly result in shorter drying times after washing in the processing cycle. It is further in favour of decolorizing properties to have said suitable dyes in form of finely dispersed form and more preferred in solid particle dispersed form as has specifically been given in EP-A 0 724 191 and in a more general way in EP-A 0 756 201.

In addition thereto it is recommended to prepare aqueous solid dispersions in colloidal silica for any photographically useful compound as has been described e.g. in EP-A 0 569 074. Advantages with respect to thin layer coating and rapid processing ability can be expected, without enhancing pressure sensitivity of more vulnerable layers.

Backing layers applied to a material having at least one emulsion layer at one side of a light-sensitive silver halide material used in the method of the present invention essentially contain as ingredients hydrophilic colloids, one or more antihalation dye(s), matting agent(s), surfactant(s), antistatic agent(s), lubricant(s) and hardening agent(s), said ingredients being same as discussed hereinbefore. Amounts of hydrophilic colloids may be chosen in order to prevent curl of the single side emulsion coated material, such as in U.S. Pat. No. 5,155,013. Also non-swelling hydrophobic polymers can be used in the backing layer as has e.g. been described in U.S. Pat. No. 5,326,686. Further measures to prevent curling have been disclosed e.g. in JP-A's 02-24645; 02-85847 and 02-87138.

The support of the black-and-white photographic materials comprising silver halide emulsion having crystals, used in the method of the present invention, more particularly for X-ray imaging, may be a transparent resin, preferably a blue colored polyester support like polyethylene terephthalate. The thickness of such organic resin film is preferably about 175 μm. Other hydrophobic resin supports are well known to those skilled in the art and are made e.g. of polystyrene, polyvinyl chloride, polycarbonate and polyethylene naphthalate. The support is further provided with a substrate layer at both sides to have good adhesion properties between the adjacent layers and said support: one or more subbing layers known to those skilled in the art for adhering thereto a hydrophilic colloid layer may be present. Suitable subbing layers for polyethylene terephthalate supports are described e.g. in U.S. Pat. Nos. 3,397,988, 3,649,336, 4,123,278 and 4,478,907. A preferred layer arrangement wherein a subbing layer composition comprising as a latex copolymer vinylidene chloride, methylacrylate and itaconic acid has been covered with hydrophilic layers being at least one gelatinous dye containing layer comprising one or more dyes, at least one silver halide emulsion layer, at least one protective antistress layer, and optionally an afterlayer can be applied and has been described in EP-A 0 752 617. In that invention said hydrophilic layers have a swelling ratio of not more than 200% and in said hydrophilic layers are coated simultaneously by the slide-hopper coating or by the slide-hopper curtain coating technique. Further information on supports suitable for use herein can be found in RD's Nos. 36544 and 38957, Chapter XV, published September 1994 and September 1996 respectively. In the method of the present invention materials having subbed supports are preferably providing permanent antistatic character thanks to electronic conductivity of polyethylene dioxythiophene (PEDT) as those described in EP-A 0 602 713 and in EP-A 1 031 875.

In the method of the present invention all conventionally known black-and-white photographic materials can be used such as, for example, X-ray photographic materials, photographic materials for printing, photographic papers, photographic negative films, microfilms, direct positive photographic materials, super fine grain light-sensitive materials (for a LSI photomask, for a shadow mask, for a liquid crystal mask, for diffusion transfer type materials, for heat-developable photographic materials, for high-density digital recording photographic materials, photographic materials for holography, etc..In a preferred embodiment said black-and-white silver halide photographic materials are (single-side or double-side coated) radiographic materials or (single-side coated) laser-imaging materials wherein a laser source directed by digital information is "written" on a hard-copy laser film. Suitable lasers may be gas lasers or solid state lasers. As a suitable gas laser a helium/neon gas laser is well-known (absorption maximum 633 nm). As a solid state laser an infrared laser diode having a more bathochrome absorption maximum at 820 nm may be used, but nowadays also green and blue-light laser sources are available, as e.g. a YAG-laser.

As a preferred laser imager we refer to the laser imager MATRIX LR 3300, trade name product marketed by Agfa-Gevaert. Suitable single-side coated materials for use in the processing of the present invention have e.g. been described in U.S. Pat. No. 5,449,599, and in EP-A's 0 610 608, 0 712 036 and 0 794.456. Double-side coated materials have e.g. been described in U.S. Pat. Nos. 5,397,687 and 5,660,966 and in EP-A's 0 678 772 and 0 754 972. Useful multilayer assemblies have e.g. been described in EP-A 0 770 909.

In radiography the interior of objects is reproduced by means of penetrating radiation which is high energy radiation belonging to the class of X-rays, γ-rays and high energy elementary particle radiation, e.g. β-rays, electron beam or neutron radiation. For the conversion of penetrating radiation into visible light and/or ultraviolet radiation luminescent substances are used called phosphors. Light emitted imagewise by intensifying screens as in medical diagnosis irradiates a contacting photographic silver halide emulsion layer film which after exposure is developed to form therein a silver image in conformity with the X-ray image.

More specifically for use in common medical radiography the X-ray film comprises a transparent film support double-side coated with a silver halide emulsion layer. During the X-ray irradiation said film is arranged in a cassette between two X-ray conversion screens each of them making contact with their corresponding silver halide emulsion layer. Phosphors suitable for use in the conventional radiographic system must have a high prompt emission on X-ray irradiation and low after-glow in favour of image-sharpness.

An improved set of blue-light-emitting screens has e.g. been described in U.S. Pat. No. 5,381,015. Specific intensifying screens emitting ultraviolet-blue radiation have further been disclosed in U.S. Pat. Nos. 4,225,653; 4,387,141; 4,710,637; 5,112,700; 5,173,611 and 5,432,351; in EP-A's 0 650 089; 0 658 613; in W093011457 and W095015514.

Typical blue-UV emitting phosphors are tantalates and hafnates and fluorohalides of barium and strontium. In EP-A 0 820 069, particles a niobium doped, monoclinic M, yttriumtantalate phosphor and particles of an europium doped bariumfluorohalide phosphor are composing the screen.

Specific intensifying screens emitting green light radiation have been disclosed in GB 1 489 398; in U.S. Pat. Nos. 4,431,922 and 4,710,637. A typical green emitting phosphor used therein is a gadolinium oxisulphide phosphor.

Screen-film systems wherein blue and/or (ultra)violet radiation emitted by screens is absorbed by suitable films in contact therewith have been described e.g. in EP-A 0 712 034 and in EP-A 0 890 873, and in W093001521.

Screen-film systems wherein green-light emitting screens are used in contact with green sensitized silver halide films have been described e.g. in EP-A 0 678 772.

Screen/film combinations may be symmetric or asymmetric: this means that screens differing in speed and/or radiation emitted therefrom are differing and/or that there is a difference in speed and/or contrast and/or spectral sensitivity at both sides of the film support.

Although it is possible to use whatever a processing unit adapted to the requirements described hereinbefore to reach the objectives concerning a perfect link between rapid processing and ecology, the objects of this invention concerning processing have e.g. been realized in the processing unit CURIX HT 330, trade name product marketed by Agfa-Gevaert. New developments however become available with respect to processing apparatus. In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus. In a vertically oriented apparatus, it is important to avoid, or at least minimize leakage of treatment liquid from one vessel to another and carry-over as the sheet material passes through the apparatus. Furthermore it is desirable that the treatment liquid in one vessel is not contaminated by contents of the adjacent vessels, that is neither by the treatment liquid of the next higher vessel nor by vapours escaping from the next lower vessel. In order to reduce consumption of treatment liquids, it is furthermore desirable to reduce the evaporation, oxidation and carbonization thereof. A solution therefore has been proposed in U.S. Pat. No. 5,652,939, wherein it has been disclosed that contamination and evaporation, oxidation and carbonization can both be reduced in a simple manner by a particular construction of the apparatus for the processing of photographic sheet material comprising a plurality of cells mounted one above the other in a stack to define a substantially vertical sheet material path through the apparatus, each cell comprising a housing within which is mounted a rotatable roller biased towards a reaction surface to define a roller nip there-between through which the sheet material path extends and associated sealing means serving to provide a gas-and liquid-tight seal between the roller and reaction surface on the one hand and a wall of the housing on the other. According to a first aspect, invention is characterized by means for connecting each cell to adjacent cells in the stack in a closed manner and according to a second aspect, the invention is characterized in that the roller is a drive roller. Particularly the objectives set forth above may be achieved when the developing cell of the apparatus is a closed cell and the developing liquid contains an ascorbic acid developing agent as has been described in EP-Application No. 96201753, filed Jun. 24, 1996. According to that invention, there is provided a method of processing photographic sheet material by use of an apparatus comprising a plurality of processing cells so arranged to define a sheet material path through the apparatus, at least one of the cells constituting a developing cell containing a developing liquid, characterized in that the developing cell is a closed cell and the developing liquid contains an ascorbic acid developing agent. With respect to further characteristics of the processing apparatus suitable for use in the processing method of the present invention we refer to EP-A 0 819 992, wherein it was an object to provide an apparatus in which operating components can easily be replaced without the need for substantial re-programming of the CPU (central processing unit).

Having described in detail preferred embodiments of the current invention, it will now be apparent to those skilled in the art that numerous modifications can be made therein without departing from the scope of the invention as defined in the appending claims and which will become clear from the following examples.

EXAMPLES

Following Materials were exposed and processed as described hereinafter in order to make an evaluation of image tone obtained after processing of the said materials in developer G138i (trademarketed product from Agfa-Gevaert N.V.) and in same developer after adding thereto the compound(s) given hereinafter.

Material No.1: MAMMORAY MR6 Film (trademarked product from Agfa-Gevaert N.V.) No. 37450058 (having in the light-sensitive emulsion layer a silver bromoiodide emulsion having monodisperse cubic crystals with an average grain diameter of 0.7 $\mu$m and a variation coefficient thereupon of about 0.15).

Material No.2: CURIX ORTHO Film (trademarked product from Agfa-Gevaert N.V.) No. 39445055 having in the light-sensitive layers at both sides of the film support a silver bromoiodide emulsion (99 mole % of AgBr, 1 mole % of AgI, based on silver) having {111} tabular crystals with an average volume equivalent diameter of 0.70 $\mu$m and an average grain thickness of 0.23 $\mu$m.

Material No.3: CURIX ORTHO Film (trademarked product from Agfa-Gevaert N.V.) 39475106 having in the light-sensitive layers at both sides of the film support a silver bromoiodide emulsion (99.9 mole % of AgBr, 0.1 mole % of AgI, based on silver) having {111} tabular crystals with an average volume equivalent diameter of 0.55 $\mu$m and an average grain thickness of 0.13 $\mu$m.

Material No.4: FUJI HRE30 Film (trademarked product from Fuji Photo Film, Japan) 3068601 having in the light-sensitive layers at both sides of the film support having in the light-sensitive layers at both sides of the film support a silver bromoiodide emulsion (99.9 mole % of AgBr, 0.1 mole % of AgI, based on silver) having {111} tabular crystals with an average volume equivalent diameter of 0.55 $\mu$m and an average grain thickness of 0.15 $\mu$m.

Samples of these coated materials were exposed with green light of 540 nm during 0.1 seconds using a continuous wedge and were processed The "comparative processing" (comp.) was run in the "comparative developer" G138i (CD) and in the fixer G334, both trademarked products from Agfa-Gevaert N.V., Mortsel, Belgium, followed by rinsing at the indicated temperature of 33° C. for a total processing time of 90 seconds.

The "inventive processing" (inv.) was run in a processing cycle according to the processing method of the present invention, wherein the "inventive developer" G138i (ID) was used, differing from the "comparative" in that compound (II) was added in an amount of 10 (ID1), 25 (ID2) and 50 mg (ID3) per 100 ml of developer. The same fixer G334 was used.

Compound (II) was added as a test compound to the developer in the experiments, leading to the results obtained in Table 1.

(II)

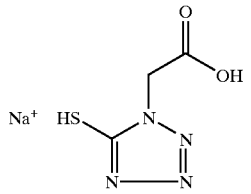

Further parameters given in Table 1 are

Fog "F", given as an integer after having multiplied the real fog density as measured with a factor of 1000;

Speed "S", given as an integer after having multiplied the sensitivity measured at a density of 1.00 above minimum density as measured with a factor of 100; —an decrease of speed with a figure of 30 corresponding with a doubling in speed —;

Gradation (contrast) "GG", given as an integer after having multiplied with a factor of 100 the real gradation—contrast—figure as measured between a density of 1.0 and 2.0 above minimum density;

Image tone "IT", evaluated from figures corresponding with $D_r$, wherefore data are summarized with respect to the density $D_r$ measured through a red filter at a density $D_b$=2 behind a blue filter: the higher this value (figure multiplied by a factor of 100), the better (more desired blue-black instead of undesired red-brown) is the color of the developed silver. Differences of 0.02 are considered to be significant as being visually perceptible.

TABLE 1

| Addition of compound (II) to the developer | | | | | |
|---|---|---|---|---|---|
| Matl. No. | Dev. | F | S | GG | IT |
| 1 | CD | 227 | 131 | 395 | 208 |
| 1 | ID1 | 232 | 130 | 375 | 209 |
| 1 | ID2 | 241 | 132 | 375 | 210 |
| 1 | ID3 | 228 | 138 | 362 | 211 |
| 2 | CD | 218 | 164 | 278 | 200 |
| 2 | ID1 | 223 | 160 | 268 | 201 |
| 2 | ID2 | 225 | 162 | 281 | 203 |
| 2 | ID3 | 231 | 162 | 244 | 205 |
| 3 | CD | 203 | 158 | 305 | 192 |
| 3 | ID1 | 202 | 158 | 290 | 193 |
| 3 | ID2 | 204 | 159 | 301 | 194 |
| 3 | ID3 | 204 | 164 | 270 | 197 |
| 4 | CD | 226 | 162 | 297 | 194 |
| 4 | ID1 | 227 | 162 | 313 | 196 |
| 4 | ID2 | 227 | 166 | 288 | 198 |
| 4 | ID3 | 224 | 171 | 258 | 203 |

As becomes clear from the data given in Table 1 an increased amount of compound (II) added to the developer composition in the processing provides an improved image tone for the correspondingly processed material, if compared with a material coated with a comparative developer having no such additive in its composition.

Only if present in the highest amounts as applied in the present example said compound (II) may have an influence on fog (supressing fog, speed and gradation which become slightly increased for fog and decreased for both speed and gradation respectively, at lower levels of said compound).

Example 2

Emulsions A1 and A2 (Tabular Silver Chloroiodide Emulsions)

In order to prepare Emulsion A1 the following solutions were prepared:

5.72 l of a dispersion medium (C) containing 0.47 moles of sodium chloride, 100 g of inert gelatin and 398 mg of adenine; temperature was established at 55° C. and pH was maintained at a value of 6.0;

a 2.94 molar silver nitrate solution (A);

a solution containing 2.756 moles of sodium chloride, 0.015 moles of potassium iodide and 420 mg of adenin (B1).

A nucleation step was performed by introducing solution A and solution B1 simultaneously in dispersion medium C, both at a flow rate of 70 ml/min, during 30 seconds at a stirring rate of 500 r.p.m.. After a physical ripening time of 20 min during which the temperature was raised to 70° C., a first growth step was performed. This was done by introducing in the reaction vessel during 29 minutes solution A and B1 by double jet addition: solution A, starting at a flow rate of 10.0 ml/min and linearly increasing the flow rate to an end value of 27.4 ml/min, solution B1 at an increasing flow rate in order to maintain a constant mV-value of +115 mV (pAg=7.16) measured by a silver electrode versus a Ag/AgCl Ingold reference electrode. Then a second growth step was started after a physical ripening time of 5 minutes by introducing, during 26 min and 27 sec, by double jet: solution A, maintaining first during 4 min a flow rate of 10.0 ml/min, then increasing the flow rate linearly to an end value of 19.80 ml/min; solution B1 at a flow rate in order to maintain a constant mV-value of 135 mV (pAg=6.86).

Finally, an amount of a potassium iodide solution (1 wt %) was added to this dispersion medium in an amount in order to get a total amount of iodide of 1 mole %. After cooling the emulsion to about 40° C., 24 ml of polystyrene sulphonic acid was added, and the pH value of the said dispersing medium was adjusted to a value of 3.0. The emulsion was flocculated, decanted and washed three times with an amount of 4 l of demineralized water in order to remove the soluble salts present.

The Emulsion A1 thus obtained was consisting of an amount by number of more than 90% of tabular grains having 2 parallel {111}-faces. The crystals were characterized by an average circular diameter of 0.85 μm and an average volume equivalent diameter dM of 0.64 μm and an average thickness of 0.14 μm. The silver halide composition was represented as AgCl(99%)I (1%).

In the following way Emulsion A2 was prepared, analoguous as Emulsion A1, except for a few aspects.

The following solutions were prepared 5.77 l of a dispersion medium (C) containing 0.47 moles of sodium chloride, 50 g of inert gelatin and 440 mg of adenine; temperature was established at 55° C. and pH was maintained at a value of 6.0;

a 2.94 molar silver nitrate solution (A);

a solution containing 3.02 moles of sodium chloride, 0.0127 moles of potassium iodide and 420 mg of adenin (B1).

A nucleation step was performed by introducing solution A and solution B1 simultaneously in dispersion medium C, both at a flow rate of 70 ml/min, during 30 seconds at a stirring rate of 500 r.p.m.. After a physical ripening time of 20 min during which the temperature was raised to 70° C., a first growth step was performed. This was done by introducing in the reaction vessel during 29 minutes solution A and B1 by double jet addition: solution A, starting at a flow rate of 10.0 ml/min and linearly increasing the flow rate to an end value of 27.4 ml/min, solution B1 at an increasing flow rate in order to maintain a constant mV-value of +115 mV (pAg=7.16) measured by a silver electrode versus a Ag/AgCl Ingold reference electrode. Then a second growth step was started after a physical ripening time of 5 minutes by introducing, during 26 min and 27 sec, by double jet: solution A, maintaining first during 4 min a flow rate of 10.0 ml/min, then increasing the flow rate linearly to an end value of 19.80 ml/min; solution B1 at a flow rate in order to maintain a constant mV-value of 135 mV (pAg=6.86).

Finally, an amount of a Lippmann emulsion (100 mole % of AgI, having very fine grains with a diameter of less than 0.050 μm) was added to this dispersion medium in an amount in order to get a total amount of iodide of 0.7 mole %. After cooling the emulsion to about 40° C., 24 ml of polystyrene sulphonic acid was added, and the pH value of the said dispersing medium was adjusted to a value of 3.0. The emulsion was flocculated, decanted and washed three times with an amount of 4 l of demineralized water in order to remove the soluble salts present.

The Emulsion A2 thus obtained was consisting of more than 90% of tabular grains, by number, having 2 parallel {111}-faces. The crystals were characterized by an average aspect ratio of 6.2, an average circular diameter of 0.85 μm and an average volume equivalent diameter dM of 0.64 μm. The silver halide composition was represented as AgCl(99.3%)I(0.7%).

Before the start of the chemical ripening the mV-value of the redispersed emulsions A and B were adjusted at +120 mV with sodium chloride and the pH-value at 5.5 with sodium hydroxide.

As a green spectral sensitizer anhydro-5,5'-dichloro-3,3'-bis-(n-sulphobutyl)-9-ethyl-oxacarbo-cyanine was added in an amount of 1.25 mmole per mole of silver. As chemical ripening agents, added after the spectral sensitizer, gold thiocyanate and sodium thiosulphate as a source of sulphur were added, whereas toluene thiosulphonic acid was used as predigestion agent. The amounts of each chemical ripening were optimized in order to obtain an optimal fog-sensitivity relationship after 2 hours at 57° C.

Before coating each emulsion was stabilized with 1-p-carboxyphenyl-5-mercaptotetrazole and after addition of the normal coating additives the solutions were coated simultaneously together with a protective layer containing 1.3 g gelatine per $m^2$ per side on both sides of a polyethylene terephthalate film support having a thickness of 175 μm. The resulting photographic materials A1 and A2 were containing per side an amount of silver halide corresponding to 3.5 grams of silver per $m^2$ and an amount of gelatin corresponding to 2.80 $g/m^2$.

Samples of these coatings were exposed with green light of 540 nm during 0.1 seconds using a continuous wedge and were processed The processing was run in the developer A the composition of which is given hereinafter (the "comparative processing" (comp.) was run in the "comparative developer A" (CDA), followed by fixing in fixer A'(see composition given hereinafter) and rinsing at the indicated temperature of 35° C. for a total processing time of 45 seconds.

| Developer A | | |
|---|---|---|
| 1-phenyl-4-methyl-4'hydroxy-methyl-pyrazolidine-3-one | 2 | g/l |
| Sodium EDTA | 2 | g/l |
| Potassium bromide | 3.3 | |
| Potassium thiocyanate | | g/l |
| Potassium sulphite | 1 | g/l |
| Potassium carbonate | 33 | g/l |
| Polyglycol (M.W. = ca. 400) | 96 | g/l |
| Compound (x) | 20 | |
| Ascorbic Acid | | ml/l |
| pH ready-for-use | 1 | g/l |
| | 50 | g/l |
| | 10.0 | |
| **Fixer A'** | | |
| Ammonium thiosulphate | 710 | ml |
| (60% solution, wherein 1 ml comprises 0.778 g) | | |
| Sodium metabisulphite | 80 | g |
| Sodium acetate | 130 | g |
| Acetic acid | 31 | ml |
| pH ready-for-use (after dilution 1 + 3) | 4.90 | |

The "inventive processing" (inv.) was run in a processing cycle according to the processing method of the present invention, wherein the "inventive developer" (IDA) was used, differing from the "comparative" in that compound (II) was added in an amount of 50 mg (IDA) per 100 ml of developer. The same fixer A' was used.

The density as a function of the light dose was measured and therefrom were determined the following parameters:

fog level F (with an accuracy of 0.001 density), value multiplied by a factor of 1000 (accuracy thus being 1);

the relative speed S at a density of 1 above fog (an increase of the said speed with a factor of 2 gives a speed value that is 0.30 lower as the relation is logarithmic and as less light is needed to get the desired density), value multiplied by a factor of 100 and speed increasing with a factor of 2 when the value of S is lower in an amount of 30, Image tone "IT", evaluated from figures corresponding with $D_r$, wherefore data are summarized with respect to the density $D_r$ measured through a red filter at a density $D_b$=2 behind a blue filter: the higher this value (figure multiplied by a factor of 100), the better (more desired blue-black instead of undesired red-brown) is the color of the developed silver. Differences of 0.02 are considered to be significant as being visually perceptible.

TABLE 2

Addition of compound (II) to the developer A (=IDA)

| Matl. | Dev. | F | S | IT |
|---|---|---|---|---|
| A1 | CDA | 302 | 181 | 193 |
| A1 | IDA | 301 | 182 | 195 |
| A2 | CDA | 215 | 191 | 192 |
| A2 | IDA | 230 | 192 | 197 |

As becomes clear from the data given in Table 2 an increased amount of compound (II), being a mercapto azole compound particularly suitable for use when added to the developer composition in the processing method of the present invention, provides a clearly visible improved image tone for the correspondingly processed material, if compared with a material coated with a comparative developer having no such additive in its composition.

Said compound (II) also has an influence on fog (suppressing fog and speed when added in the said amount of 50 mg/l as hereinbefore). Improved image tone seems to be more pronounced if silver iodide has been added at the grain surface of the silver chloroiodide grains in form of very fine Lippmann emulsion grains is (smaller than 50 nm) having silver iodide in an amount of 100 mole % based on silver.

Having described in detail preferred embodiments in illustrative examples of the current invention, it will now be apparent to those skilled in the art that numerous modifications can be made therein without departing from the scope of the invention as defined in the appending claims.

What is claimed is:

1. Processing method of an exposed black-and-white silver halide photographic film material comprising in a hydrophilic light-sensitive layer thereof a binder and silver halide grains being {111} or {100} tabular silver bromo (chloro)iodide or silver chloro(bromo)iodide grains having an average aspect ratio of from 1.2 to 50 and having a silver iodide content of less than 3 mole % based on silver, with at least part of it at their grain surface, said method comprising the steps of developing in a developer, fixing in a fixer, rinsing and drying, wherein in said developing step the developer comprises an alkali soluble agent, which is represented by formula (I) or a salt thereof, (I)

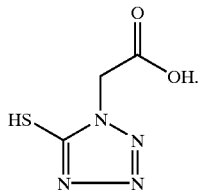

2. Processing method according to claim 1, wherein said agent is present in the developer solution in an amount of from $5\times10^{-5}$ up to $1\times10^{-3}$ mole per liter of said developer.

3. Processing method according to claim 1, wherein in the developer a main developing agent is present, said agent being selected from the group consisting of hydroquinones and reductones or a combination thereof, and wherein said reductones are members selected from the group consisting of 1-ascorbic acid, iso-ascorbic acid, and reductic acid.

4. Processing method according to claim 1, wherein said silver halide grains have a silver iodide content of from 0.1 up to 1 mole % based on silver.

5. Processing method according to claim 4, wherein said silver halide grains have silver iodide at their surfaces in an amount of from 0.1 up to 0.4 mole % based on silver.

* * * * *